United States Patent [19]

Craig

[11] Patent Number: 4,770,293

[45] Date of Patent: Sep. 13, 1988

[54] PACKAGING METHOD AND PACKAGES

[76] Inventor: Peter B. Craig, 41 Blackburn Street, Frankton, New Zealand

[21] Appl. No.: 22,481

[22] Filed: Mar. 6, 1987

Related U.S. Application Data

[63] Continuation of Ser. No. 783,566, Oct. 3, 1985, abandoned.

[51] Int. Cl.[4] ..... B65D 55/00

[52] U.S. Cl. ..... 206/45; 206/557; 53/456

[58] Field of Search ..... 53/DIG. 1, 427, 432, 53/433, 441, 442, 509, 517, 456; 206/45, 557

[56] References Cited

U.S. PATENT DOCUMENTS

| | | | |
|---|---|---|---|
| 2,103,241 | 12/1937 | Bell | 206/45 |
| 2,466,191 | 4/1949 | Wiesman | 53/DIG. 1 X |
| 3,228,168 | 1/1966 | Grindrod et al. | 53/427 |
| 3,671,271 | 6/1972 | Miller | 206/557 X |
| 3,709,702 | 1/1973 | Mahaffy et al. | 53/433 X |
| 3,972,155 | 8/1976 | Mahaffy et al. | 53/427 X |
| 4,077,184 | 3/1978 | Kremer et al. | 53/509 |

*Primary Examiner*—Robert L. Spruill
*Assistant Examiner*—Steven P. Weihrouch
*Attorney, Agent, or Firm*—Gipple & Hale

[57] ABSTRACT

A packaging tray for the packaging of consumer items has at least two adjacent cavities which are designed to facilitate full utilization of the tray by allowing overlapping of articles within the tray. A package and packaging method using the tray is also described.

6 Claims, 3 Drawing Sheets

PACKAGING METHOD AND PACKAGES

This application is a continuation of application Ser. No. 783,566 filed Oct. 3, 1985 now abandoned.

BACKGROUND OF THE INVENTION

This invention relates to packaging trays, methods of packaging, and packages.

Vacuum packing is commonly used today for packing consumer goods. Such packing can be so called skin to skin, or skin to tray. Skin to skin packaging is where articles are packed between two sheets of thin flexible material such as a plastics film. Skin to tray packaging is where articles are supported in a stiff semi-rigid tray and the tray and articles therein are covered with a thin film. In some cases the interior of the package is evacuated prior to the film coming into contact with the film or tray, or articles within the package. One of the problems in the field of skin to tray packaging is that the number of articles which can be packed within a tray is restricted by the need to provide a clear space about the periphery of the article where film to tray contact can be made so that the film is adhered to the tray at the point of contact between the tray and the film. In processes which use pressure differentials to unite the film to the tray any void areas between the article within the tray and the base of the tray tend to cause the plastics material to be drawn into same resulting in a rupture or an inadequate evacuation of air.

Methods and packages used by others in this field are described in Australian Patent Specification No. 70181/83 (Grace), UK Patent Application No. 2041318A (Van Oordt) and Australian Patent No. 401097 (Oscar Mayer).

It is an object of the present invention to provide a packaging tray which will enable a number of items to be efficiently and economically packed in the tray.

Further objects and advantages of the present invention will become apparent from the ensuing description which is given by way of example.

SUMMARY OF THE INVENTION

According to the present invention there is provided an open semi-rigid tray for receiving articles, said tray having at least two adjacent cavities therein the first of which has an article receiving surface which is adapted to accommodate substantially in full one article of a pre-determined size, and an adjacent cavity or cavities having an article receiving surface of reduced size which inclined towards or away from the first cavity the arrangement and construction being such that when two articles of the said pre-determined size are placed in adjacent cavities a portion of each article overlaps or is overlapped by the article in or from the cavity next to it.

According to a further aspect of the present invention there is provided a package for articles comprising a tray as aforesaid and a thin flexible material covering the cavities and articles therein said package being sealed at least about the periphery of the rim of the tray.

According to yet a further aspect of the present invention, there is provided a method of packaging utilising a tray as aforesaid, said method comprising the steps of loading each of the cavities in the tray with articles so that each article overlaps or is overlapped by the one next to it and drawing onto the tray a flexible sheet material, and fixing the flexible sheet material at least at the rim of the tray.

Aspects of the present invention will now be described by way of example with reference to the accompanying drawings in which:

DETAILED DESCRIPTION OF PREFERRED EMBODIMENT OF THE INVENTION

Figure 1:
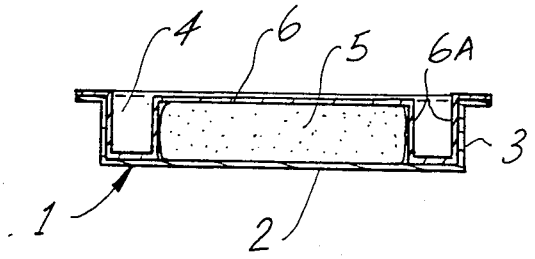
FIG. 1 PRIOR ART
FIGS. 1 and 2 are diagrammatic cross-sections of known vacuum packed packages.
Figure 2:
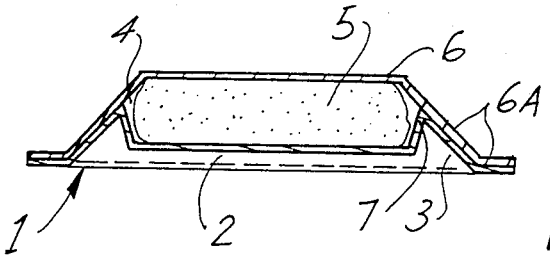
FIG. 2 PRIOR ART

Referring firstly to FIGS. 1 and 2 of the drawings illustrating examples of known forms of packaging, the packaging trays generally indicated by arrow 1 comprise a base 2, sides 3 and an open top 4. A consumer item 5 is packed within the tray and a film 6 is fixed to and encloses the exposed areas of the trays.

In the FIG. 1 embodiment the tray 1 has a flat base 2 and FIG. 2 illustrates another common form of packaging tray where the base 2 is raised from sides 3 and the consumer item 5 extends above the level of a rim 7 formed between the base and sides of the tray 2.

The trays 2 can be pre-formed and these are usually made by a vacuum moulding machine.

Where the trays are used for packaging foods, a plastics film 6 in a soft heated condition is overlayed over the tray and the edges 6A are sealed in relation to the sides and/or the base thereof. Where the consumer item 5 is a food, the application of the plastics film 6 to the tray is usually conducted within a vacuum chamber the operation of which is such that all air is drawn out of the pocket created between the tray 1 and the film 6 in which the consumer item 5 is placed prior to the application of the film. In some cases the film 6 is in close co-operation with the consumer item 5 as well as the edges and rim of the tray at the completion of the packaging operation.

As indicated earlier, one of the difficulties with existing methods is that the item to be packed needs to be in contact with the base of the tray and there needs to be a clear space about the periphery of each tray so that the plastics film 6 can be drawn onto and adhered to the tray in these regions. This restricts the number of items (particularly more rigid items) that can be packed in a single tray.

Figure 3:
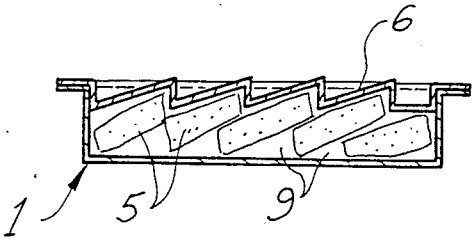
FIG. 3 PRIOR ART
FIG. 3 is a diagrammatic cross-section of a package similar to that illustrated by FIG. 1 but where articles within the tray are overlapping.

If for example, as illustrated by FIG. 3, one attempts to utilise the tray to a maximum in terms of the number of consumer items 5 placed therein by packing so that each item 5 overlaps or is overlapped by the one next to it then there is created a number of void areas 9 at the edges of the items 5 and during the final process step when the film 6 is applied to the package, the film tends to be drawn to the void areas with the result that the plastics will rupture and/or a complete evacuation of air is not achieved.

Figure 4:
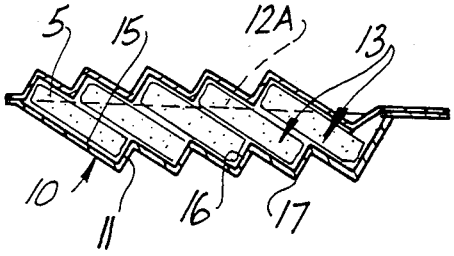
FIGS. 4 and 5 illustrate two different embodiments of an open semi-rigid tray and package in accordance with the present invention.
Figure 5:
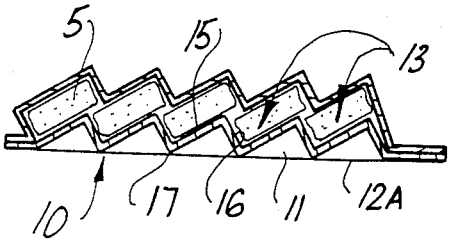
Figure 6:
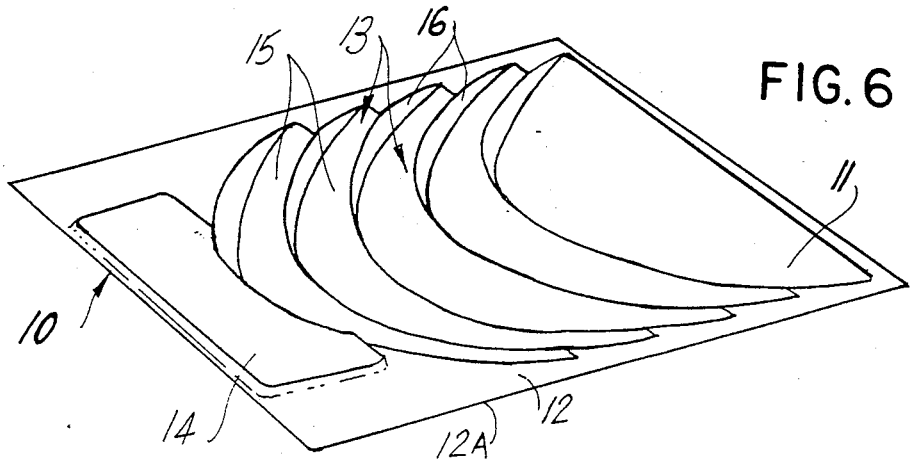
FIG. 6 is a perspective view of a semi-rigid tray in accordance with the present invention.

FIGS. 4, 5 and 6 of the drawings illustrate two different embodiments of a tray in accordance with the present invention each having a "stepped" base. The trays generally indicated by arrow 10 have a base 11 and sides 12 with the base 11 having a plurality stepped cavities generally indicated by arrow 13 therein for receiving consumer items 5. The cavities 13 are of a size in relation to the items 5 placed therein that each item overlaps or is overlapped by the one next to it and the base of the tray is only accessible at regions where the overlapped portions do not cover same. In this way the void areas 9 in the example of FIG. 3 are avoided. Two or more cavities 13 can be provided and in the example illustrated the cavities 13 are provided in a single row although it will be appreciated that a number of rows in a tray may be provided. The sides 12 of the tray provide a peripheral rim 12A which surrounds the cavities 13, and, as illustrated by FIG. 6, a label fixing portion 14 can be provided on the rim. The label fixing portion 14 may be provided in a pre-moulded tray by moulding into the rim 12 a raised peripheral border, or in the alternative, the label fixing portion may be plain or in the form of an open topped trough or the like. Each of the cavities 13 has an article receiving surface 15 and a stepped portion 16 which joins the article receiving surface 15 of the cavity next to it. For the trays illustrated by FIGS. 4 and 6 of the drawings, merging edges 17 of the article receiving surface and the stepped portions 16 define lower parts of the tray upon which it can be supported. In the example of FIG. 5 the merging edges 17 and the rim 12A provide support for the tray.

The size of the cavities 13 in each tray and their shape can be pre-determined by the corresponding shape of articles to be placed within the cavity. For example in the embodiments illustrated the cavities 13 are designed to accommodate cuts of meat, chops or the like, and it is therefore convenient to provide arcuate shape to the article receiving surface 15 and the stepped portions 16 and in each case the edges 18 merge towards sides of the tray.

The trays 10 can be pre-moulded in clear or other types of plastics or indeed in any type of mouldable materials such as coated cardboard or the like and may be reuseable or disposed of by the user.

One utilization of the packaging tray of the present invention is in film to tray packaging of foodstuffs, in which the package pocket is evacuated within a vacuum chamber prior to sealing. FIGS. 7 to 11 illustrate typical apparatus and process steps.

Figure 7:
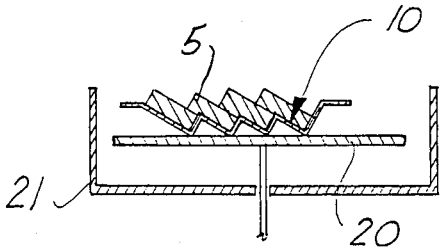
FIGS. 7, 8, 9, 10 and 11 are diagrammatic sectional drawings of one possible method for producing an air tight package using the tray of the present invention.
Figure 8:
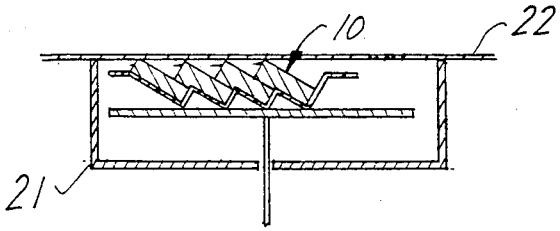
Figure 9:
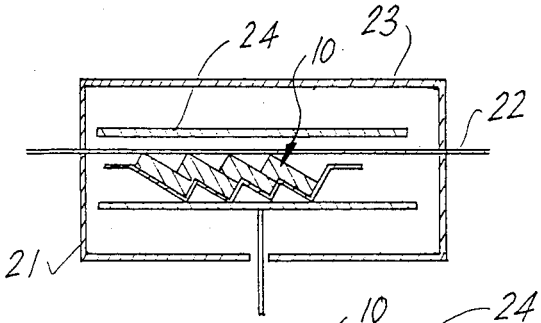
Figure 10:
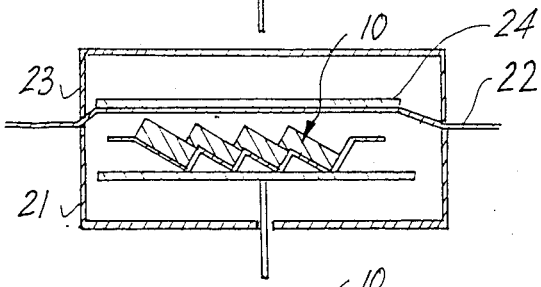
Figure 11:
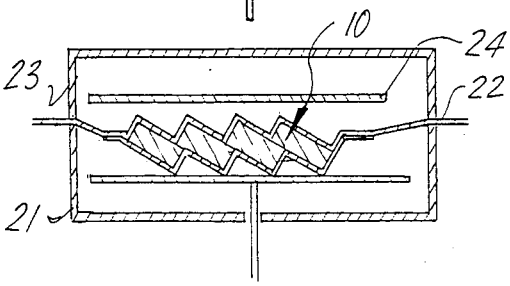

Initially, as illustrated by FIG. 7, the open topped tray 10 is loaded with items 5 and supported on a fixture or movable platen 20. The bottom chamber 21 of the apparatus surrounds the support platen 20. Next plastics film 22 is introduced over the lower vacuum chamber 21 as shown by FIG. 8, and then a vacuum chamber upper section 23 is introduced over the lower chamber 21 as illustrated by FIG. 9. Once the chamber is closed the pressures within the chamber are altered to draw the film 22 onto a heater 24 of the upper chamber 23 and the plastics is softened. Finally, the pressures within the vacuum chamber are altered again and the film 22 is drawn onto the package and the film seals at least about the periphery of the tray 10. For food packaging the pockets of the interiors of the package are evacuated as the film is drawn down onto the trays to produce a hermetically sealed package. The package is then removed from the vacuum chamber.

Whilst the present invention is useful for packaging food items such as meats, it will be appreciated that other articles can be packed in the trays with similar advantage.

Aspects of the present invention have been described by way of example only and it will be appreciated that modifications and additions thereto may be made without departing from the scope of the invention as defined in the appended claims.

I claim:

1. A method of packaging comprising;

(a) performing a first sheet of semi-rigid material into a packaging tray having a first cavity with an article receiving surface which is adapted to accommodate substantially in full one article of a predetermined size and configuration and an adjacent cavity of reduced size having an inclined article receiving surface;

(b) placing in the first cavity an article which is accommodated substantially in full by the first cavity;

(c) placing in the adjacent cavity an article of substantially the same size and configuration as the first article so that a portion of the article in the adjacent cavity overlaps the article in the first cavity and the overlapped portions of each article are in surface to surface contact, and (d) drawing a thin flexible sheet over the loaded tray so that the sheet is adhered to exposed surfacing of the packaging tray accessible from above the tray and articles within the tray.

2. A method of packaging as claimed in claim 1 wherein said tray has sides and the cavities preformed in the semi-rigid material are of a stepped cross-section which reduces in width approaching the sides of the tray and merges with a rim extending about the sides of the tray.

3. The method of claim 1 including providing a plurality of cavaties adjacent said first cavity and placing an article in each cavity such that a portion of an article in each of said adjacent cavities overlaps an adjacent article in surface to surface contact.

4. An open unitary semi-rigid tray for receiving articles, said tray comprising at least two adjacent cavities merging with a substantially horizontally extending peripheral rim formed by the sides of said tray, a first of said cavities having an article receiving surface which is inclined away from the vertical which supports the full face of one of said articles of predetermined size to be stored in the tray and a back surface which intersects with the article receiving surface and is substantially perpendicular to the article receiving surface, said first cavity being of predetermined size and configuration so that in use, it supports substantially in full, said item of predetermined size and configuration, a second cavity having an article receiving surface which is also inclined away from the vertical and which in use, supports a representative portion of the full face of a second of said articles of predetermined size and configuration and an intersecting back surface which intersects with the article receiving surface of the second cavity and which is substantially perpendicular with the article receiving surface, the depth of each cavity of the tray being predetermined so as to accommodate substantially in full the depth of the articles placed in them, the arrangement being such that when a first article of said predetermined size and configuration is placed in the first cavity, and a second article of substantially similar size and configuration is placed in the second cavity a portion of said second article overlaps and is in surface to surface contact with the article below it and a full face of the second article is visible from above the tray whilst only a representative portion of the first article is visible from the same position, the overlapping of the items being to the extent that the articles are accommodated within the cavities and any remaining surfaces are accessible from the above said tray.

5. A tray as claimed in claim 4 adapted for packaging meat cuts wherein each of the cavities is of a substantially stepped cross section which reduces in width approaching the sides of the tray and merges with said trim extending about the periphery thereof.

6. A tray as claimed in claim 4 in which said horizontally extending peripheral rim is provided with a label fixing portion integrally formed therewith.

* * * * *